US009011174B2

(12) United States Patent
Kashiyama et al.

(10) Patent No.: US 9,011,174 B2
(45) Date of Patent: Apr. 21, 2015

(54) CONNECTOR WITH CABLE PROTECTING PROJECTION

(75) Inventors: Motohisa Kashiyama, Makinohara (JP); Yasuharu Kondo, Kikugawa (JP)

(73) Assignee: Yazaki Corporation, Tokyo (JP)

( * ) Notice: Subject to any disclaimer, the term of this patent is extended or adjusted under 35 U.S.C. 154(b) by 31 days.

(21) Appl. No.: 13/577,038

(22) PCT Filed: Feb. 3, 2011

(86) PCT No.: PCT/JP2011/052295

§ 371 (c)(1),
(2), (4) Date: Aug. 3, 2012

(87) PCT Pub. No.: WO2011/096497

PCT Pub. Date: Aug. 11, 2011

(65) Prior Publication Data

US 2012/0302090 A1 Nov. 29, 2012

(30) Foreign Application Priority Data

Feb. 3, 2010 (JP) ..... 2010-022209

(51) Int. Cl.

| | |
|---|---|
| ***H01R 13/40*** | (2006.01) |
| ***H01R 13/52*** | (2006.01) |
| ***H01R 13/56*** | (2006.01) |
| *H01R 9/03* | (2006.01) |

(52) U.S. Cl.

CPC ..... *H01R 13/5216* (2013.01); *H01R 13/567* (2013.01); *H01R 9/03* (2013.01)

(58) Field of Classification Search

USPC ..... 439/271–275, 447, 587, 404

See application file for complete search history.

(56) References Cited

U.S. PATENT DOCUMENTS

| | | | | | |
|---|---|---|---|---|---|
| 4,150,866 | A | * | 4/1979 | Snyder et al. | 439/275 |
| 4,713,021 | A | * | 12/1987 | Kobler | 439/272 |
| 5,266,045 | A | * | 11/1993 | Yamamoto et al. | 439/275 |
| 5,498,172 | A | * | 3/1996 | Noda | 439/404 |
| 5,562,494 | A | * | 10/1996 | Fujiwara | 439/587 |
| 5,645,451 | A | * | 7/1997 | Ohsumi et al. | 439/587 |
| 5,927,725 | A | * | 7/1999 | Tabata et al. | 277/607 |

(Continued)

FOREIGN PATENT DOCUMENTS

| | | | |
|---|---|---|---|
| CN | 1188996 | A | 7/1998 |
| CN | 1407667 | A | 4/2003 |

(Continued)

OTHER PUBLICATIONS

Extended European Search Report, dated May 6, 2013, issued by the European Patent Office in counterpart European Patent Application No. 11739845.3.

(Continued)

*Primary Examiner* — Thanh Tam Le

(74) *Attorney, Agent, or Firm* — Sughrue Mion, PLLC

(57) ABSTRACT

A connector is provided which can prevent damage to cables, and hold and waterproof the ends of the cables. A connector has accommodating parts which accommodate the ends of cables where connection terminals are provided. The ends of the cables are held by elastic holding members which are filled and solidified in the accommodating parts, and cable protecting projections which are projected with an arc shaped cross section towards the cables are formed at the edges of walls which form the accommodating parts at the outlet sides of the cables.

3 Claims, 5 Drawing Sheets

(56) References Cited

U.S. PATENT DOCUMENTS

| | | | | |
|---|---|---|---|---|
| 5,931,699 | A * | 8/1999 | Saito | 439/587 |
| 6,071,147 | A * | 6/2000 | Tsukamoto | 439/587 |
| 6,196,872 | B1 * | 3/2001 | Murakami et al. | 439/587 |
| 6,231,388 | B1 | 5/2001 | Murakami et al. | |
| 6,273,755 | B1 | 8/2001 | Yamamoto | |
| 6,398,585 | B1 | 6/2002 | Fukuda | |
| 6,722,914 | B2 * | 4/2004 | Blaha | 439/404 |
| 7,033,215 | B2 * | 4/2006 | Kobayashi | 439/587 |
| 7,575,458 | B2 * | 8/2009 | Parmeter et al. | 439/271 |
| 7,997,916 | B2 * | 8/2011 | Yoshioka et al. | 439/273 |
| 8,323,004 | B2 * | 12/2012 | Homma et al. | 417/410.1 |
| 2003/0224661 | A1 | 12/2003 | Dye et al. | |

FOREIGN PATENT DOCUMENTS

| | | | |
|---|---|---|---|
| EP | 1 182 741 | A1 | 2/2002 |
| FR | 2 893 189 | A1 | 5/2007 |
| JP | 59-21517 | U | 2/1984 |
| JP | 05-91997 | U | 12/1993 |
| JP | 05-92975 | U | 12/1993 |
| JP | 07-254455 | A | 10/1995 |
| JP | 07-296883 | A | 11/1995 |
| JP | 08-124623 | A | 5/1996 |
| JP | 11-283695 | A | 10/1999 |
| JP | 11-354200 | A | 12/1999 |
| JP | 2000-286006 | A | 10/2000 |
| JP | 2001-6801 | A | 1/2001 |
| WO | 2008/098268 | A2 | 8/2008 |

OTHER PUBLICATIONS

International Search Report for PCT/JP2011/052295 dated Mar. 1, 2011 [PCT/ISA/210].

Written Opinion for PCT/JP2011/052295 dated Mar. 1, 2011 [PCT/ISA/237].

Communication dated Apr. 23, 2014 issued by the State Intellectual Property Office of P.R. China in corresponding Chinese Application No. 201180008300.9.

Communication from the State Intellectual Property Office of P.R. China dated Dec. 18, 2014, in a counterpart application No. 201180008300.9.

* cited by examiner

CONNECTOR WITH CABLE PROTECTING PROJECTION

TECHNICAL FIELD

The invention is related to a connector to which cables of a wire harness or the like are connected.

BACKGROUND ART

Conventionally, in a connector which accommodates ends of cables where connection terminals are provided, accommodating parts which accommodate the ends of the cables in a housing are waterproofed by filling a filler into the accommodating parts or using sealing materials or the like (for example, refer to PTLs 1 to 6).

CITATION LIST

Patent Literatures

[PTL 1] JP-A-07-254455
[PTL 2] JP-A-07-296883
[PTL 3] JP-A-08-124623
[PTL 4] JP-A-11-283695
[PTL 5] JP-A-05-91997
[PTL 6] JP-U-05-92975

SUMMARY OF INVENTION

Technical Problem

The cables have such a structure that the cables are pulled out from the accommodating parts of the housing of the connector. For this reason, it is likely that the cables pulled out from the accommodating parts contact with the edges of walls which form the accommodating parts and are damaged. Especially, when the filler or the sealing material in the accommodating parts deteriorates and the cables are not sufficiently held, the cables tend to move and the possibility of contacting with the edges of the walls of the accommodating parts increases. Further, the cables may move and contact with the edges of the walls of the accommodating parts before the filler is solidified.

When the connector is carried in a vehicle or the like, since the cables pulled out from the accommodating parts of the connector are vibrated and moved, the damage due to the contact of the cables with the edges of the walls will appear notably.

The invention is made in view of the problems mentioned above, and the object of the invention is to provide a connector which can prevent damage to cables, and hold and waterproof the ends of the cables.

Solution to Problem

In order to achieve the purpose mentioned above, a connector according to the invention is characterized by the following (1) or (2).

(1) A connector, comprising:

an accommodating part which accommodates an end of a cable where a connection terminal is provided, wherein the end of the cable is held by elastic holding member which is filled and solidified in the accommodating part, and a cable protecting projection which has an arc shaped cross section and is projected towards the cable is formed at an edge of a wall which forms the accommodating part at an outlet side of the cable.

(2) The connector according to the above (1), wherein the cable pulled out from the accommodating part is arranged so as to be curved, and a cable protecting projection is provided on the wall of the accommodating part at least at a curving side of the cable.

In the connector of the structure of the above-mentioned (1), the ends of the cables which are arranged in the accommodating parts can be held by the holding members which are filled into the accommodating parts and solidified, and the degradation of the connection terminals can be prevented by sealing the inside of the accommodating parts.

Since the cable protecting projections which are projected with an arc shaped cross section toward the cables are formed at the edges of the walls, which form the accommodating parts, at the outlet sides of the cables, for example, even if the cables are pulled towards the walls of the accommodating parts during the filling and solidifying of the holding members or the cables are not well held because the holding members deteriorate with time, the cables are held by abutting against the cable protecting projections which are projected with an arc shaped cross section. Therefore, the damage produced when the cables contact the edges of the walls of the accommodating parts can be prevented. Therefore, even if the connector is carried in a vehicle or the like, and the cables which are pulled out from the accommodating parts of the connector vibrate and move, the damage due to the contact of the cables with the edges of the walls can be definitely prevented.

In the connector of the structure of the above-mentioned (2), since the cables pulled out from the accommodating parts are arranged so as to be curved, and the cable protecting projections are provided on the walls of the accommodating parts at the curving sides of the cables, even if the cables are pulled towards the curving sides, damage produced when the cables contact with the edges of the walls of the accommodating parts can be prevented.

Advantageous Effects of Invention

According to the invention, the connector can be provided which can prevent damage to cables, and hold and waterproof the ends of the cables.

The invention is explained in brief above. Further, details of the invention will become more apparent after the embodiments of the invention described below are read with reference to the accompanying figures.

DESCRIPTION OF EMBODIMENTS

Below, the embodiments of the invention are explained with reference to the figures.

Figure 1:
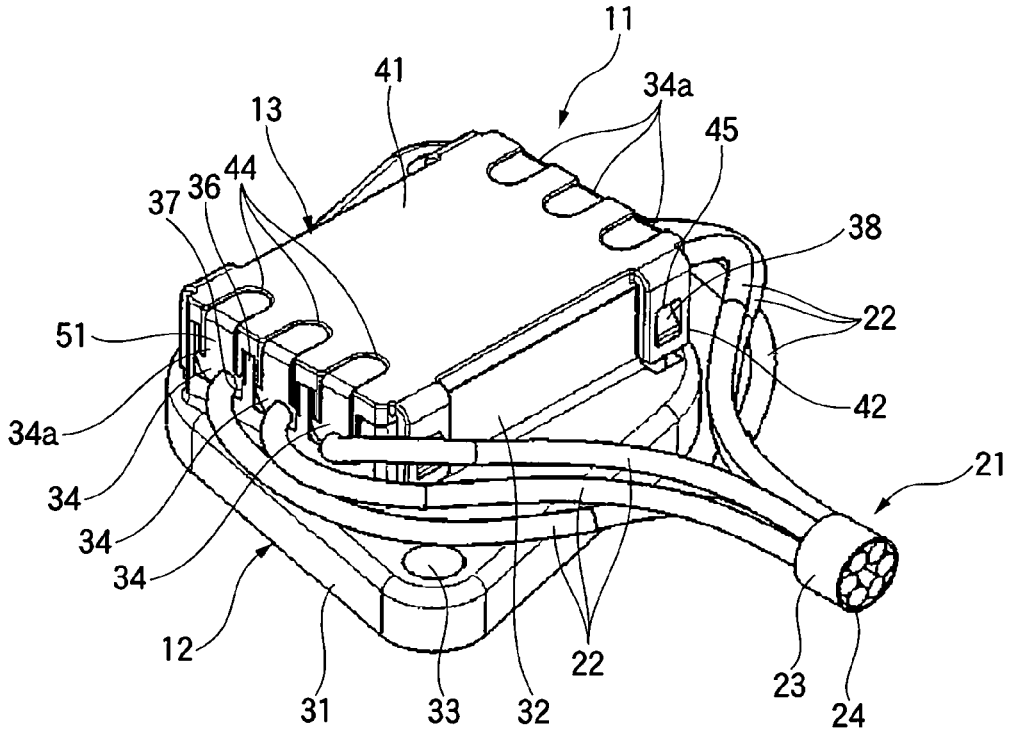
FIG. 1 is a perspective view of a connector according to an embodiment of the invention.
Figure 2:
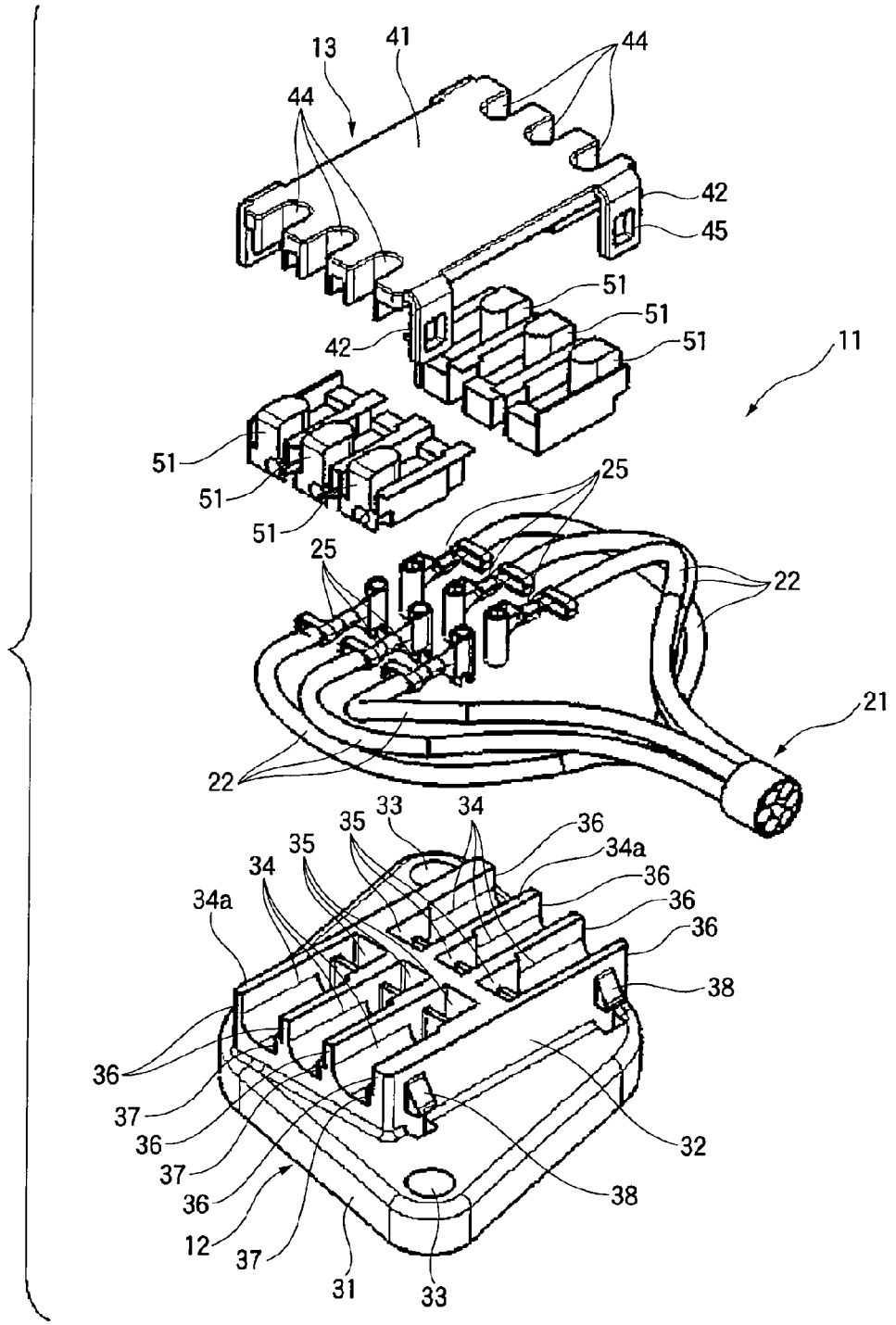
FIG. 2 is an exploded perspective view of the connector according to the embodiment of the invention.
Figure 3:
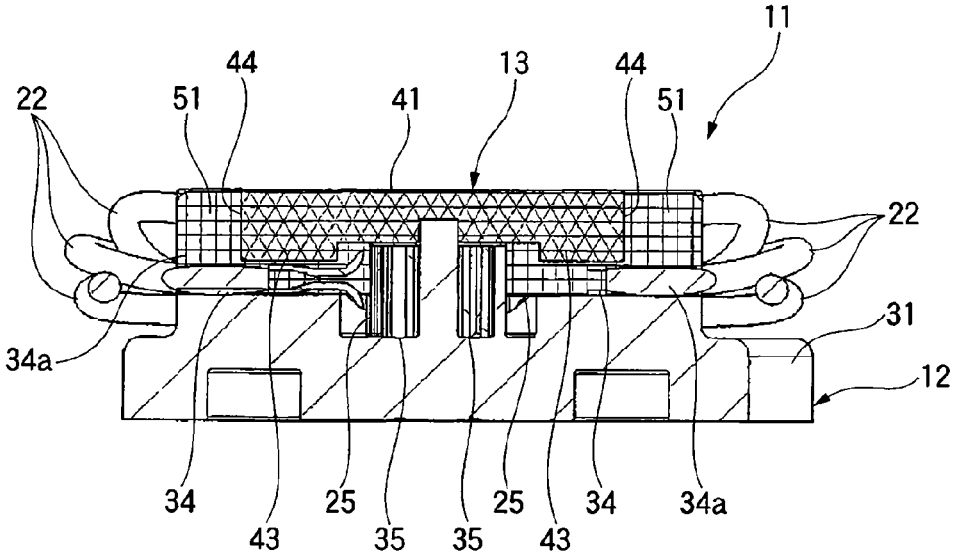
FIG. 3 is a sectional view of the connector according to the embodiment of the invention.
Figure 4:
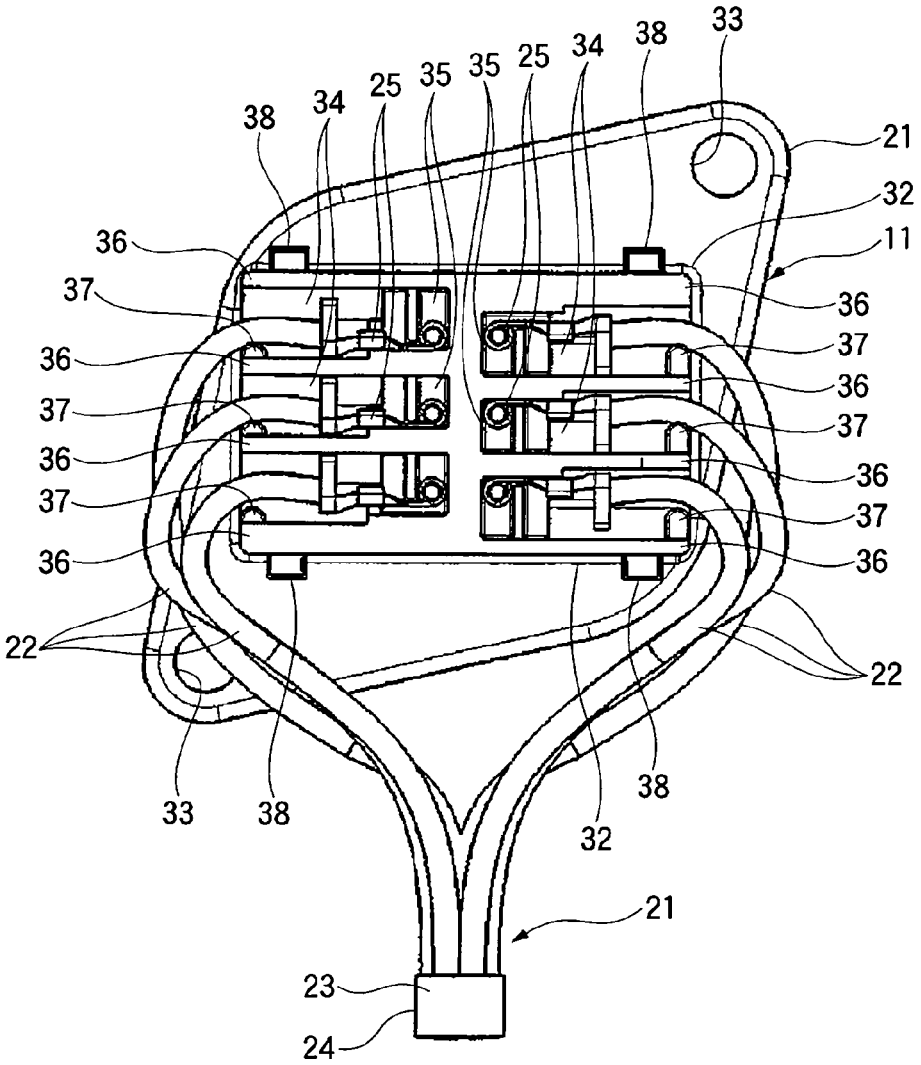
FIG. 4 is a top view of a housing of the connector in which cables of a wire harness are arranged.
Figure 5:
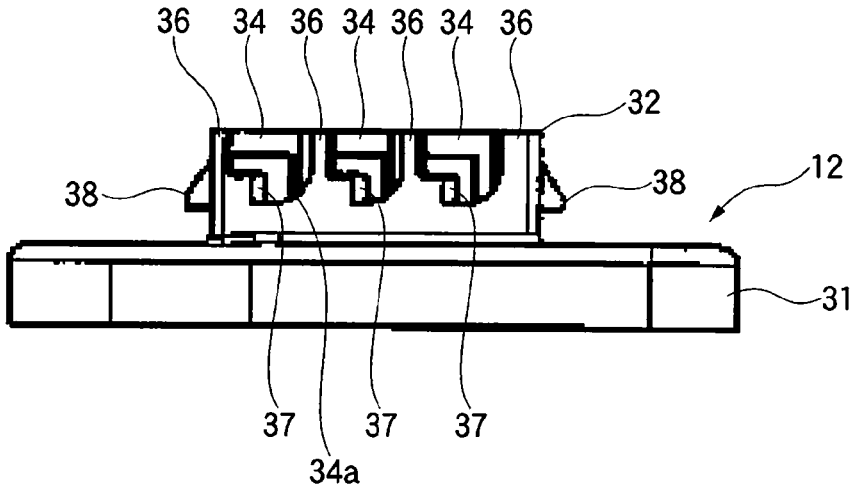
FIG. 5 is a side view of the housing of the connector.

FIG. 1 is a perspective view of a connector according to an embodiment of the invention, FIG. 2 is an exploded perspective view of the connector according to the embodiment of the invention, FIG. 3 is a sectional view of the connector according to the embodiment of the invention, FIG. 4 is a top view of a housing of the connector in which cables of a wire harness are arranged, and FIG. 5 is a side view of the housing of the connector.

As shown in FIGS. 1 to 4, a connector 11 according to the embodiment has a housing 12 and a cover 13 which is attached to the housing 12, and a wire harness 21 is connected to the connector 11.

The wire harness 21 has a plurality of cables 22 in which electric wires are covered with resin, and a part in which these cables 22 are bundled by a sleeve 23 is a bundled part 24.

Connection terminals 25 are connected to the ends of the cables 22 of the wire harness 21, respectively.

The housing 12 is formed of resin or metal, and as shown in FIG. 5, has a base part 31 and a connecting part 32 which is formed on the top of the base part 31.

Mounting holes 33 are formed in the base part 31, and when bolts are inserted through these mounting holes 33, for example, the base part 31 can be fixed to a mounted part such as the frame of a vehicle.

The connecting part 32 has a plurality of accommodating parts 34. As shown in FIG. 4, these accommodating parts 34, when viewed from top, are formed to be multiple ones for each of the right and left sides (three for each in the embodiment) at opposite positions.

One end side of the accommodating part 34 is a terminal holding part 35, and the upper side and the other end side of the accommodating part 34 are opened, and the other end side which is opened is an outlet 34*a* for the cable 22.

The ends of the cables 22 of the wire harness 21 are inserted into these accommodating parts 34, and the connection terminals 25 which are provided at the ends of the cables 22 are respectively connected to the terminal holding parts 35.

The cables 22 of the wire harness 21 are branched at the end of the wire harness 21, and are arranged towards the connector and from both sides of the connector 11 to the accommodating parts 34, respectively. Thereby, the cables 22 are curved between the bundled part 24 and the accommodating parts 34 of the connector 11.

On walls 36 which form the accommodating parts 34, cable protecting projections 37 are formed at the edges at the outlet sides of the cables 22. These cable protecting projections 37 are formed to have an arc shaped cross section, and are formed at the edges of the walls 36 at the curving sides of the cables 22.

A plurality of locking claws 38 are formed on side surfaces of the connecting part 32 of the housing 12.

The cover 13 which is attached to the top surface of the housing 12 is formed of resin or metal and is provided with a cover plate 41 which covers the top surface of the connecting part 32 of the housing 12, and locking pieces 42 which are formed at both sides of the cover plate 41.

A plurality of protrusions 43 which fit into the accommodating parts 34 of the connecting part 32 are formed on the surface of the cover plate 41 that faces the housing 12, and the connection terminals 25 of the cables 22 which are arranged in the accommodating parts 34 are pressed and held by these protrusions 43. Recesses 44 are formed at positions of the cover plate 41 that correspond to the edges of the accommodating parts 34.

The locking pieces 42 have locking holes 45, respectively, and are projected to the direction of attaching to the housing 12. The locking claws 38 formed on the side surfaces of the connecting part 32 of the housing 12 are locked in the locking holes 45 of these locking pieces 42, and thereby the cover 13 is attached to the connecting part 32 of the housing 12.

In the connector 11 of the above-mentioned structure, the spaces in the accommodating parts 34 are filled with holding members 51 which have elasticity.

The holding members 51 are formed by filling filler into the accommodating parts 34, and making it solidify. After the ends of the cables 22 are accommodated in the accommodating parts 34 of the housing 12 and the cover 13 are attached, the filler is filled into the accommodating parts 34 from the recesses 44 of the cover 13 at the sides of the outlets 34*a* for the cables 22.

While the accommodating parts 34 are sealed by the holding members 51 which have elasticity, the ends of the cables 22 where the connection terminals 25 are provided are held.

Since the above-mentioned connector 11 has the plurality of accommodating parts 34 and the ends of the cables 22 are accommodated in these accommodating parts 34, respectively, a proper amount of filler can be smoothly filled into the accommodating parts 34, and the cables 22 can be well hold by the holding members 51.

Thus, according to the connector 11 in the above-mentioned embodiment, the ends of the cables 22 which are arranged in the accommodating parts 34 can be held by the holding members 51 which are filled into the accommodating parts 34 and solidified, and the degradation of the connection terminals 25 can be prevented by sealing the inside of the accommodating parts 34.

Since the cable protecting projections 37 which are projected with an arc shaped cross section toward the cables 22 are formed at the edges of the walls 36, which form the accommodating parts 34 at the curving sides of the cables 22, at the outlet sides of the cables 22, for example, even if the cables 22 are pulled towards the walls 36 of the accommodating parts 34 during the filling and solidifying of the holding members 51 or the cables 22 are not well held because the holding members 51 deteriorate with time, the cables 22 are held by abutting against the cable protecting projections 37 which are formed with an arc shaped cross section.

Therefore, the damage produced when the cables 22 contact the edges of the walls 36 of the accommodating parts 34 can be prevented. Therefore, even if the connector 11 is carried in a vehicle or the like, and the cables 22 which are pulled out from the accommodating parts 34 of the connector 11 vibrate and move, the damage due to the contact of the cables 22 with the edges of the walls 36 can be definitely prevented.

That is, according to the above-mentioned connector 11, while the ends of the cables 22 can be held and waterproofed, the damage to the cables 22 can be prevented.

Since the directions of pulling out the cables 22 from the accommodating parts 34 are maintained along straight lines as much as possible by the cable protecting projections 37, the load of the cables 22 at the positions where the connection terminals 25 are connected can be suppressed, and defects, such as an open circuit in the positions where the connection terminals 25 are connected, also can be definitely prevented. Thereby, the flexibility of the directions of pulling out the cables 22 can be improved, and the wiring of the wire harness 21 can be facilitated.

The invention is not restricted to the above-described embodiment, and suitable modifications, improvements and the like can be made. Moreover, the materials, shapes, dimensions, numerical values, forms, numbers, installation places and the like of the components are arbitrarily set as far as the invention can be attained, and not particularly restricted.

Although the present invention is described in detail with reference to the embodiments, it is apparent that various modifications and amendments may be made by those skilled in the art without departing from the spirit and scope of the invention.

This application is based on the Japanese patent application (patent application 2010-022209) filed on Feb. 3, 2010, whose content is incorporated herein by reference.

Reference Signs List

11 CONNECTOR
22 CABLE
25 CONNECTION TERMINAL
34 ACCOMMODATING PART
36 WALL
37 CABLE PROTECTING PROJECTION
51 HOLDING MEMBER

The invention claimed is:

1. A connector, comprising:

an accommodating part which accommodates an end of a cable where a connection terminal is provided, wherein the accommodating part comprises two walls, and the end of the cable is held by an elastic holding member which is filled and solidified in the accommodating part; and a cable protecting projection, which has a first end formed at an edge of an inner face of a first wall of the two walls at an outlet side of the cable and a second opposite end, wherein the second opposite end has a semi-ellipse shaped cross section, wherein the cable protecting projection is projected from the first end to the second end, and wherein the cable is disposed between the second end and a second wall of the two walls.

2. The connector according to claim 1, wherein the cable pulled out from the accommodating part is arranged so as to be curved, and the cable protecting projection is provided on the first wall of the accommodating part at least at a curving side of the cable.

3. The connector according to claim 1, wherein a longitudinal axis of the first wall extends in a first direction, and the cable protecting projection is projected in a second direction which intersects the first direction.

* * * * *